US008435165B2

(12) United States Patent
Bock et al.

(10) Patent No.: US 8,435,165 B2
(45) Date of Patent: May 7, 2013

(54) TOP-FILLING DUNNAGE CONVERSION MACHINE AND METHOD

(75) Inventors: Manfred Bock, Brüggen (DE); Pedro Erik Willem Winkens, JB Vaals (NL)

(73) Assignee: Ranpak Corp., Concord Township, OH (US)

( * ) Notice: Subject to any disclaimer, the term of this patent is extended or adjusted under 35 U.S.C. 154(b) by 330 days.

(21) Appl. No.: 12/937,033

(22) PCT Filed: Apr. 21, 2009

(86) PCT No.: PCT/US2009/041210

§ 371 (c)(1),
(2), (4) Date: Oct. 8, 2010

(87) PCT Pub. No.: WO2009/131981

PCT Pub. Date: Oct. 29, 2009

(65) Prior Publication Data

US 2011/0034311 A1 Feb. 10, 2011

Related U.S. Application Data

(60) Provisional application No. 61/046,888, filed on Apr. 22, 2008.

(51) Int. Cl.
*B31B 1/26* (2006.01)

(52) U.S. Cl.
USPC ..... 493/405; 493/461; 493/967

(58) Field of Classification Search ..... 493/405, 493/461–464, 967; 53/139.5, 122; 156/183
See application file for complete search history.

(56) References Cited

U.S. PATENT DOCUMENTS

| | | | | |
|---|---|---|---|---|
| 5,188,581 | A | 2/1993 | Baldacci | |
| 6,632,165 | B1 | 10/2003 | Letourneau et al. | |
| 6,676,589 | B2 | 1/2004 | Kung et al. | |
| 7,186,208 | B2 * | 3/2007 | Demers et al. | 493/350 |
| 7,788,884 | B2 * | 9/2010 | Cheich et al. | 53/472 |
| 7,803,100 | B2 * | 9/2010 | Lu et al. | 493/464 |
| 8,177,697 | B2 * | 5/2012 | Cheich et al. | 493/25 |
| 2008/0153685 | A1 * | 6/2008 | Cheich et al. | 493/381 |
| 2009/0082187 | A1 * | 3/2009 | Cheich et al. | 493/350 |

FOREIGN PATENT DOCUMENTS

WO 2006/052980 5/2006

OTHER PUBLICATIONS

International Search Report and Written Opinion of the International Searching Authority for corresponding International Application No. PCT/US2009/041210, dated Jul. 30, 2009.

* cited by examiner

*Primary Examiner* — Hemant M Desai
(74) *Attorney, Agent, or Firm* — Renner, Otto, Boisselle & Sklar, LLP

(57) ABSTRACT

A dunnage conversion machine (10) and method for providing strips of dunnage that better fill a void in a container are characterized by means (24) for separately guiding at least two sheets of stock material (14 and 16) to respective laterally-disposed regions of an inlet (20) to a conversion assembly (40) such that one sheet does not wrap around another sheet, and means (12) for converting the sheets into strips of dunnage that can readily separate and follow separate paths.

18 Claims, 4 Drawing Sheets

TOP-FILLING DUNNAGE CONVERSION MACHINE AND METHOD

This application is a national phase of International Application No. PCT/US2009/041210, filed Apr. 21, 2009, and published in English as WO 2009/131981 on Oct. 28, 2009, which claims the benefit of U.S. Provisional Patent Application No. 61/046,888, filed Apr. 22, 2008, which are incorporated herein by reference.

FIELD OF THE INVENTION

This invention relates generally to a dunnage dispensing system for supplying dunnage to fill a void in a container, and more particularly to an dunnage conversion machine and method for dispensing strips of dunnage to fill a void in an upper portion of a container.

BACKGROUND

In the process of shipping one or more articles in a container, a packer typically places some type of dunnage material in the shipping container along with the articles. The dunnage material partially or completely fills the empty space, the void volume, around the articles in the container to prevent or minimize any shifting of the articles in the container and/or to cushion the articles in the container during the shipping process. Some commonly used dunnage materials are plastic foam peanuts, plastic bubble pack, air bags and converted paper dunnage.

An exemplary dunnage conversion machine that converts a continuous sheet of paper into a crumpled strip of dunnage is disclosed in U.S. Pat. No. 6,676,589. Typically, as the crumpled strip is being discharged from the conversion machine a person, commonly referred to as a packer, guides, pushes and/or folds the crumpled strip into the container. A similar dunnage conversion machine has been incorporated into an automated dunnage filling system that is disclosed in International Patent Publication No. WO 2006/052980, published in the English language on May 18, 2006. Both of these documents are incorporated herein by reference.

SUMMARY

While existing strip-producing dunnage conversion machines are sufficient for many applications, the present invention provides an improved dunnage conversion machine and method for providing strips of dunnage that better fill a void in a container, particularly a shallow void in an upper portion of the container.

In particular, the present invention provides a dunnage conversion method that includes the steps of (A) separately guiding at least two sheets of stock material to respective laterally-disposed regions of an inlet to a conversion assembly such that one sheet does not wrap around another sheet, and (B) converting the sheets into strips of dunnage that can readily separate and follow separate paths. These separate strips of dunnage interact with the container, the objects being shipped, and each other to randomly bend and fold to fill the void in the container better than a single strip would, but in the same amount of time.

The present invention also provides a method wherein the guiding step includes guiding sheet stock material to circumferentially-spaced regions of the inlet.

The present invention further provides a method wherein the converting step includes inwardly gathering the sheet stock material, and/or employing a common conversion assembly to pull the sheet stock material therethrough and convert the stock material into the strips of dunnage.

In addition, the present invention proves a dunnage conversion machine that includes a conversion assembly having an inlet and an outlet that advances, inwardly gathers and crumples sheet stock material as the stock material passes through the conversion assembly; and laterally-spaced guides upstream of the conversion assembly. The laterally-spaced guides define separate paths to laterally-disposed regions of the inlet such that one sheet does not wrap around another sheet, whereby the crumpled strip exiting the outlet can readily separate and follow separate paths.

In an exemplary machine, (1) each path to the inlet extends in a different direction from a proximal end adjacent the inlet, and/or (2) the guide assembly guides the stock material to circumferentially-spaced regions of the inlet, and/or (3) the guide assembly guides stock material to opposite sides of the inlet, and/or (4) the guide assembly includes at least two guide members that define the respective paths to the inlet.

The present invention further provides a dunnage conversion machine having means for converting sheet stock material into a dunnage product as the stock material travels from an inlet to an outlet of the converting means, and means for guiding multiple sheets of stock material to respective laterally-disposed regions of the inlet of the converting means such that one sheet does not wrap around another sheet.

In an exemplary machine, the means for guiding includes multiple transverse members extending across respective paths of the stock material to guide the stock material to the inlet, and/or the means for converting pulls multiple sheets of stock material together as the stock material passes therethrough, and/or the guiding means provides a means for preventing one sheet from wrapping around another sheet in the converting means such that the strip of dunnage disposed from the conversion assembly can follow separate paths.

The foregoing and other features of the invention are hereinafter fully described and particularly pointed out in the claims, the following description and the annexed drawings setting forth in detail several illustrative embodiments of the invention, such being indicative, however, of but a few of the various ways in which the principles of the invention may be employed.

BRIEF DESCRIPTION OF THE DRAWINGS

FIG. 4 is a cross-sectional elevation view of the dunnage conversion machine as seen along line 4-4 of FIG. 3. FIG. 5 is a sequential view of FIG. 4 that illustrates operation of the dunnage conversion machine.

DETAILED DESCRIPTION

Although existing strip-producing dunnage conversion machines are sufficient for many applications, the present invention provides an improved dunnage conversion machine and method for providing strips of dunnage that better fill a void in a container, particularly a shallow void in an upper portion of the container.

Figure 1:
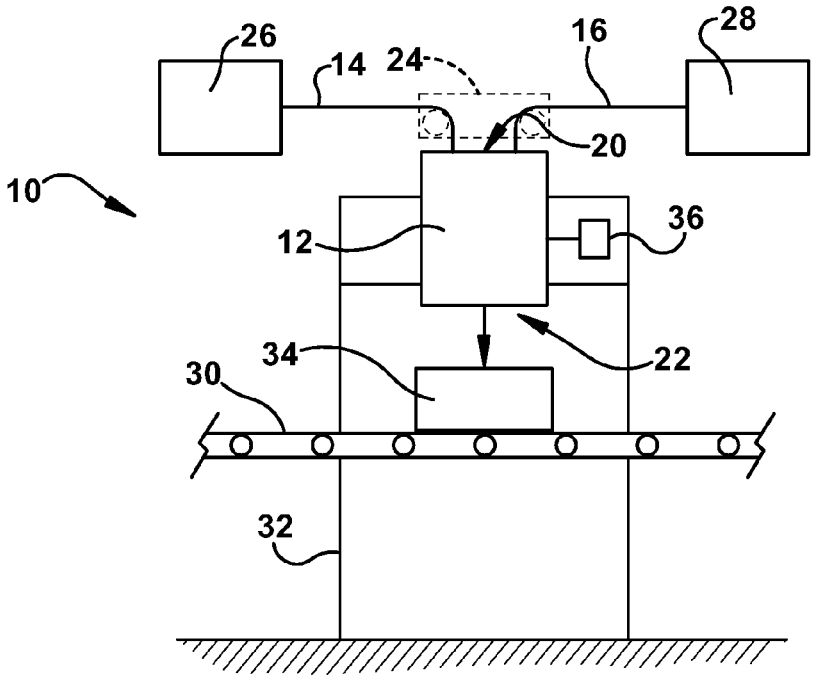
FIG. 1 is a schematic elevational view of a top-filling dunnage conversion machine according to the present invention.
Figure 2:
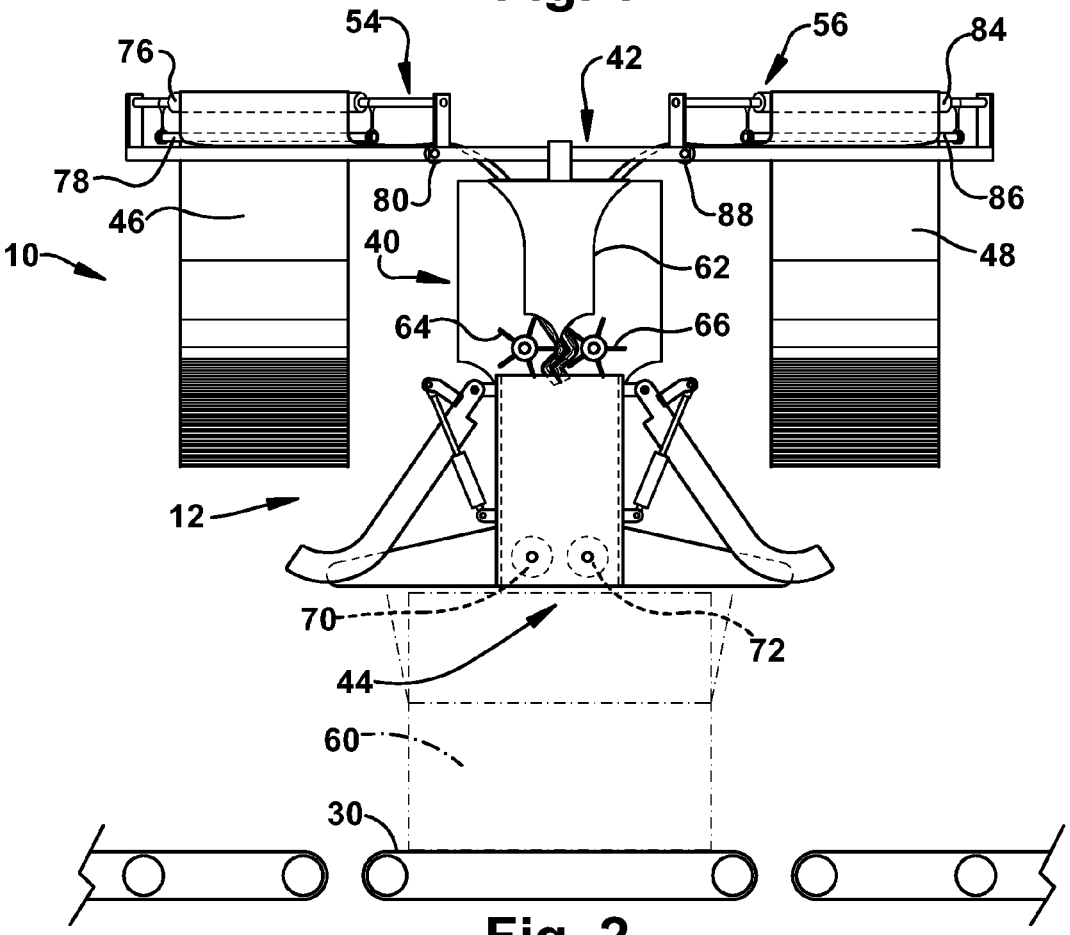
FIG. 2 is an elevational view of a portion of an exemplary embodiment of the conversion machine in FIG. 1.
Figure 3:
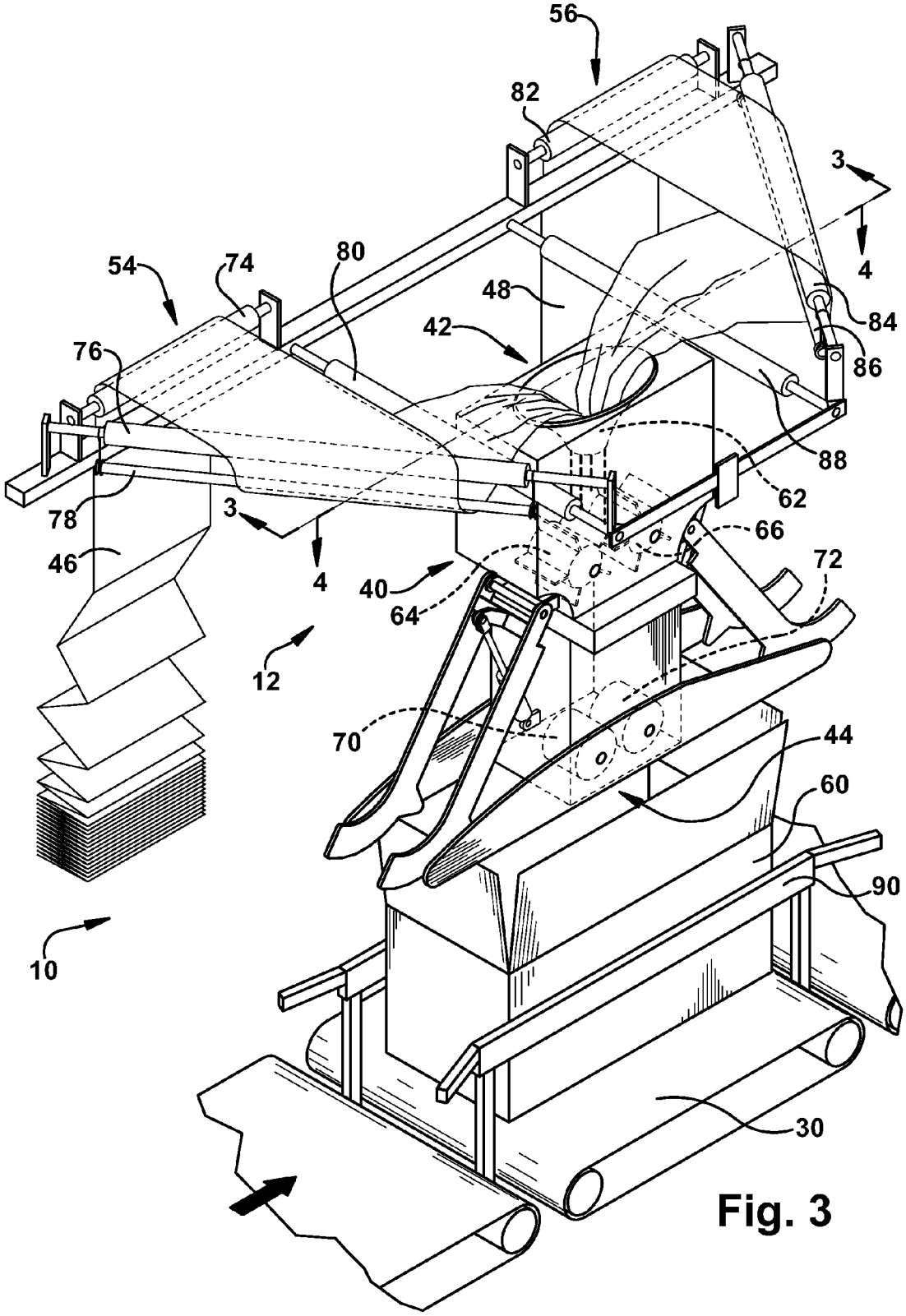
FIG. 3 is an enlarged perspective view of the dunnage conversion machine in FIG. 2.

Referring now to the drawings in detail, and initially to FIG. 1, a dunnage conversion machine 10 provided by the present invention includes means for converting 12 multiple sheets of stock material 14 and 16 into relatively thicker and less dense strips of dunnage as the stock material travels from an inlet 20 to an outlet 22 of the converting means 12. The machine 10 also includes, upstream of the converting means 12, means for guiding 24 multiple sheets of stock material 14 and 16 to respective laterally-disposed regions of the inlet 20 of the converting means 12 such that one sheet does not wrap around another sheet. The guiding means 24 guides the sheet stock material 14 and 16 from one or more supplies, in this case two supplies 26 and 28, respectively, to an inlet 20 of the converting means 12 in such a way that the incoming sheets of stock material 14 and 16 do not nest or interlock during the conversion process. The converting means 12 can be supported at an elevated position above a packing surface 30 by a frame 32 so that the dunnage strips can be fed directly from the outlet 22 into a container 34 on the packing surface 30. A controller 36 also can be provided to control the converting means 12.

An exemplary converting means 12 is shown in FIGS. 2-5 and includes a conversion assembly 40 having an inlet 42 and an outlet 44 that advances, inwardly gathers, and crumples two or more sheets of stock material 46 and 48 as the stock material passes through the conversion assembly 40. The conversion assembly 40 dispenses crumpled strips 50 and 52 of dunnage through the outlet 44.

Figure 5:
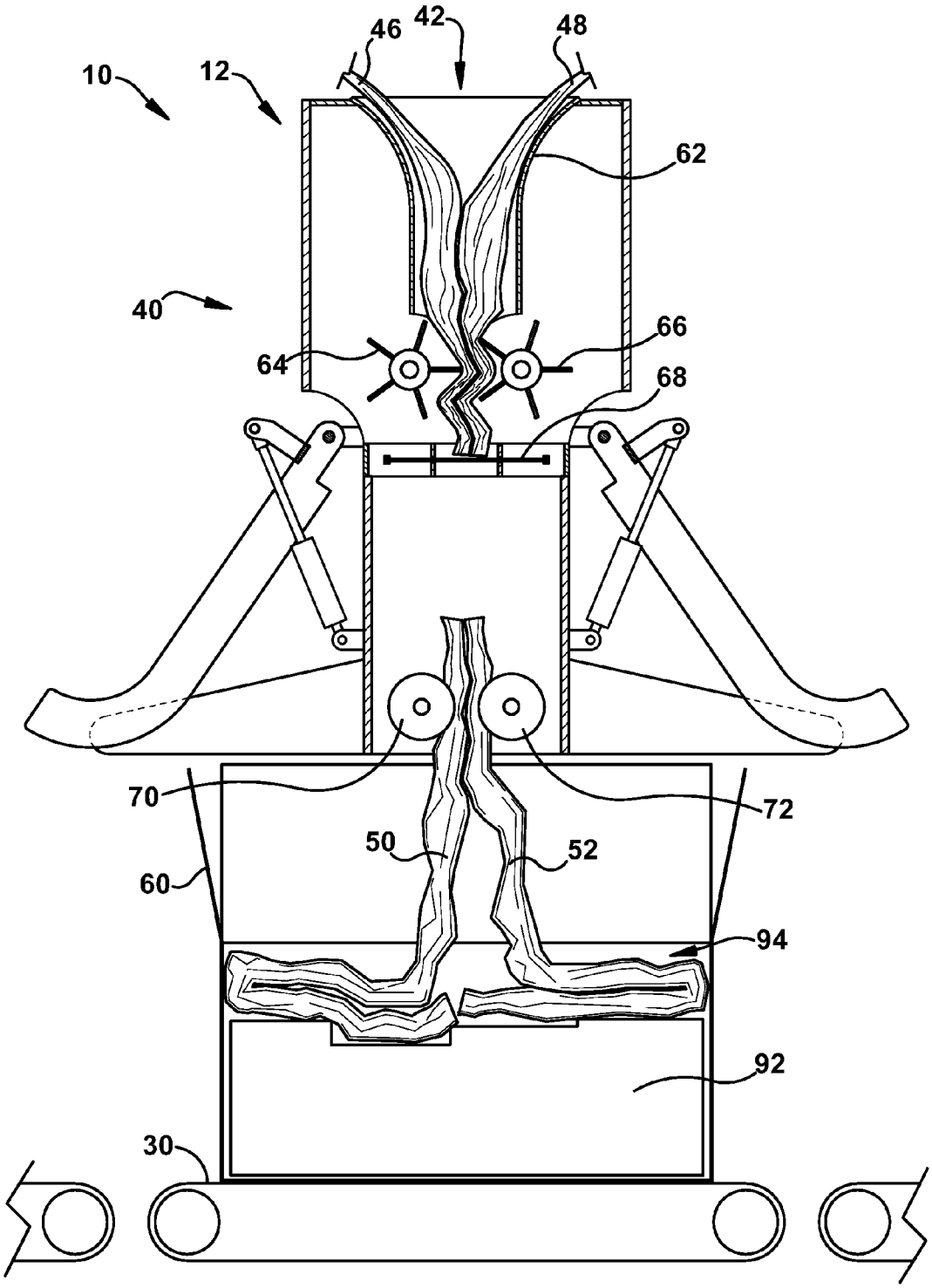

An exemplary guiding means 24 also is shown and includes laterally-spaced guides 54 and 56 upstream of the conversion assembly 40. The guiding means also can be referred to as a guide assembly. The laterally-spaced guides 54 and 56 define separate paths to laterally-disposed regions of the inlet 42 such that one sheet does not wrap around another sheet, whereby the crumpled strips 50 and 52 exiting the outlet 44 can readily separate and follow separate paths, as seen in FIG. 5. For example, as the crumpled strips of dunnage 50 and 52 exit the converting means 12 or conversion assembly 40 and enter a container, the strips can separate and in following separate paths better fill a void volume in the container, and are particularly effective in filling a relatively shallow void volume at the top of the container. "Filling" a void with dunnage includes providing dunnage to partially occupy the void as well as completely occupying the void.

Figure 4:
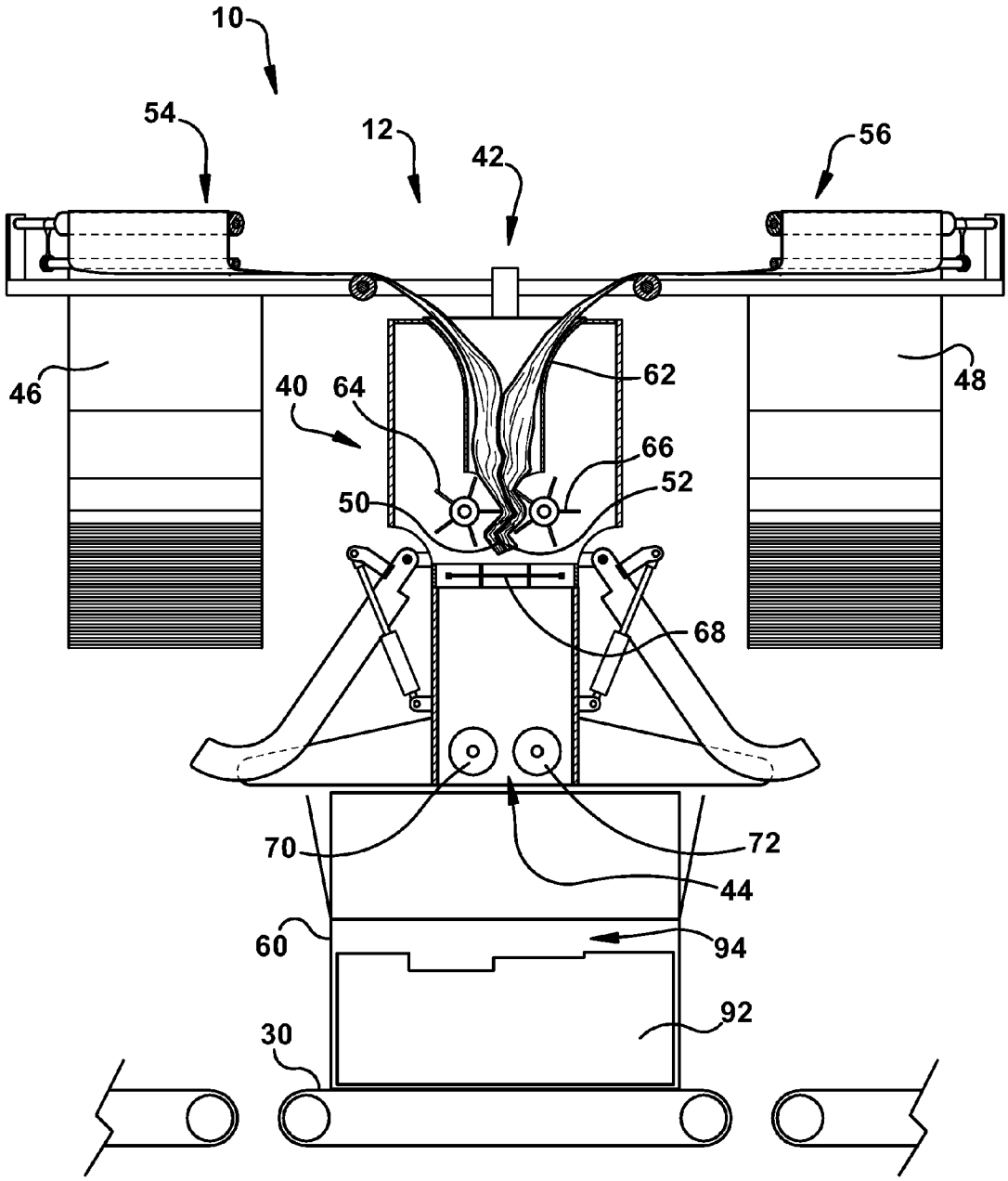
FIGS. 4-5 are sequential schematic cross-sectional elevational views of the dunnage conversion machine shown in FIG. 3 that illustrate a dispensing operation. More particularly.

In FIGS. 4 and 5, one or more objects to be shipped 92 leave a shallow void 94 at the top of the container 60. As the leading ends of the strips of dunnage 50 and 52 enter the container and engage the objects 92 in the container, the strips separate and randomly bend and fold upon themselves as they interact with the container 60, the objects being shipped 92, and other portions of the strips to fill the void within the container. The resilient nature of the dunnage strips 50 and 52 allow the void to be overfilled to some degree without compromising the cushioning properties of the strips or the ability to close the container.

An exemplary dunnage conversion machine is disclosed in U.S. Pat. No. 6,676,589, the entire disclosure of which is hereby incorporated by reference. An exemplary sheet stock material for use in such a converter includes at least one ply of kraft paper, which can be provided in a fan-folded stack. Alternatively, a sheet stock material can be provided in roll form.

As in that patent, the illustrated dunnage converter 10 includes a conversion assembly 40 that draws the sheet stock material into a funnel or converging chute 62. The converging chute 62 has its larger end adjacent to or defining the inlet 42 to the conversion machine 10 and its conversion assembly 40, and inwardly gathers and randomly crumples the stock material. The conversion assembly 40 also includes a pair of rotating feed members 62 and 64 or other moveable member for drawing the stock material through the converging chute 60, and then dispensing the crumpled strip lengthwise, along its longitudinal axis, through the outlet 44 of the conversion assembly 40. In general, the rotating feed members 64 and 66 stop, then a movable cutting blade 68 crosses the path of the strip of dunnage. The trailing end of the separated strip of dunnage is then free from its connection to the remaining stock material in the conversion machine 10.

Adjacent the outlet 44, the conversion machine 10 includes a second pair of rotating members 70 and 72 between which the strip of dunnage is propelled lengthwise out the outlet 44. The second pair of rotating members preferably propel a trailing end of the strip toward and into an open container 56, whereby upon closing the container the dunnage strip, and particularly the trailing end of the strip, will be captured therein. The rotating members 70 and 72 preferably include resilient members, such as brushes, paddle wheels or rollers that have resilient bristles, paddles or covers that resiliently frictionally engage and feed the dunnage strip, preferably without damaging its cushioning or void-filling properties. The rotating brushes 70 and 72 can be rotated at an effective tangential speed that is greater than the speed of the rotating feed members 64 and 66, whereby the brushes can slip relative to the strips of dunnage 50 and 52 but will move the trailing ends of the strips through the outlet 44 and propel them into the confines of the container 60 after the strips have been cut. Other devices can be used in place of or in addition to the illustrated rotating members.

In the illustrated embodiment, each path of the stock material to the inlet 42 of the converging chute 62 and the conversion assembly 40 extends in a different direction from a proximal end adjacent the inlet 42. More particularly, the guide assembly 24 guides the stock material to circumferentially-spaced regions of the inlet 42, and the illustrated guide assembly 24 guides stock material to opposite sides of the inlet 42. The guide assembly 24 includes at least two laterally-spaced guide members that define the respective paths to the inlet 42. The guide members extend across the path of the stock material, and the illustrated guide assembly 24 includes multiple bar-like members or rollers 74, 76, 78, 80, 82, 84, 86, and 88 that turn and direct the stock material to the inlet 42.

The stock material 46 and 48 typically is wider than a portion of the path through the conversion assembly 40, such as the downstream end of the converging chute 62 or the passage between the rotating members 70 and 72. Accordingly, the conversion assembly 40 inwardly gathers the stock material and crumples the stock material, creating longitudinally-extending folds and creases in the stock material. The guide assembly 24 guides the various sheets of stock material to laterally-disposed, including circumferentially-spaced, regions of the inlet 42 to prevent or minimize the likelihood that the sheets will nest and interlock as they are inwardly gathered and crumpled by the conversion assembly 40. Consequently, lateral portions of the stock material are inwardly drawn in different directions, and lateral regions of adjacent sheets rotate in different directions relative to longitudinal centerlines of respective sheets. By combining the guide assembly with a single conversion assembly, the present invention provides multiple strips of dunnage in the same time as a single strip with minimal additional structure. And by feeding multiple strips through a common outlet we believe that the strips interact with each other in a way that improves the paths taken to fill the void.

As will be appreciated, the dunnage conversion machine and related components may be used to pack many different types of containers, although in most instances the container will be a box, also referred to as a carton. Consequently, the terms box, container and carton are for the most part herein used interchangeably. A typical shipping container or box has a closed bottom side, substantially vertical side walls perpendicular to the bottom side and to adjacent side walls, and an open top side bounded by opposing pairs of flaps extending upward from top edges of the side walls. The flaps are foldable along a horizontal fold line at the top edge of the side walls to close the open side of the container. In place of or in addition to such a container, a shoebox-style container that does not have flaps can be used in some situations. This type of container is closed by a lid placed over the open side of the container.

As noted above with regard to FIG. 1, the dunnage conversion machine 10 also includes a controller 36 for controlling the conversion machine 10 and its components. The controller 36 can be composed of one or more processors and associated peripheral devices for controlling the various components of the machine 10 and/or the transport of the container. Individual components may have their own controllers which may be viewed as forming part of an overall system controller. An exemplary controller is a programmable logic controller (PLC). In conjunction with signals from a device that can be used to identify the void volume, the controller 36 can control the dunnage conversion machine 10 to produce and to dispense a quantity of dunnage to fill the void.

In addition to the conversion machine 10, an exemplary packaging system includes the packaging surface 30. The packaging surface 30 can include a container support and/or transport assembly such as a table, a stand, a conveyor or other surface that can support the container adjacent the conversion machine for receipt of the dunnage. The illustrated embodiment includes a conveyor as the packing surface 30. The conveyor can be controllably started and stopped to move the container, and can include one continuous conveyor or a plurality of conveyor segments. The conveyor also includes a positioning device 90 (FIG. 3) to register or otherwise position the container relative to and aligned with the outlet 44 of the dunnage conversion machine 10.

In summary, a dunnage conversion machine and method for providing strips of dunnage that better fill a void in a container are characterized by means for separately guiding at least two sheets of stock material to respective laterally-disposed regions of an inlet to a conversion assembly such that one sheet does not wrap around another sheet and become fixed thereto during the conversion process. The machine also includes means for converting the sheets into strips of relatively thicker and less dense dunnage that can readily separate and follow separate paths in the container to which the strips are dispensed.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed is:

1. A dunnage conversion method comprising the steps of (A) separately guiding at least two sheets of stock material to respective circumferentially-spaced regions of an inlet to a conversion assembly such that one sheet does not wrap around another sheet; and (B) converting the sheets into strips of dunnage that can readily separate and follow separate paths.

2. A method as set forth in claim 1, wherein the guiding step includes guiding sheet stock material to opposite sides of the inlet.

3. A method as set forth in claim 1, wherein the guiding step includes changing the direction of the sheet stock material as it is drawn from a supply and into the inlet.

4. A method as set forth in claim 1, wherein the converting step includes inwardly gathering the sheet stock material.

5. A method as set forth in claim 1, wherein the converting step includes employing a common conversion assembly to pull the sheet stock material therethrough and convert the stock material into the strips of dunnage.

6. A method as set forth in claim 1, wherein the converting step includes dispensing multiple strips of dunnage lengthwise through a common outlet into a container such that the strips will curl or fold back and forth upon themselves within the container.

7. A dunnage conversion machine, comprising: a conversion assembly having an inlet and an outlet that advances, inwardly gathers and crumples sheet stock material as the stock material passes through the conversion assembly; and guides upstream of the conversion assembly that define separate paths to circumferentially-spaced regions of the inlet such that one sheet does not wrap around another sheet, whereby the crumpled strip exiting the outlet can readily separate and follow separate paths.

8. A machine as set forth in claim 7, wherein each path to the inlet extends in a different direction from a proximal end adjacent the inlet.

9. A machine as set forth in claim 7, wherein the guide assembly guides stock material to opposite sides of the inlet.

10. A machine as set forth in claim 7, wherein the guide assembly includes at least two guide members that define the respective paths to the inlet.

11. A machine as set forth in claim 10, wherein the guide members extend across the path of the stock material.

12. A machine as set forth in claim 11, wherein the guide members include a bar-like member or a roller.

13. A machine as set forth in claim 7, wherein the conversion assembly includes a converging chute having its larger end adjacent to or defining the inlet.

14. A machine as set forth in claim 7, wherein the conversion assembly includes a movable member for drawing stock material through the conversion assembly to dispense a strip of dunnage lengthwise through the outlet.

15. A dunnage conversion machine, comprising means for converting sheet stock material into a dunnage product as the stock material travels from an inlet to an outlet of the converting means; and means for guiding multiple sheets of stock material to respective laterally-disposed regions of the inlet of the converting means such that one sheet does not wrap around another sheet.

16. A machine as set forth in claim 15, wherein the means for guiding includes multiple transverse members extending across respective paths of the stock material to guide the stock material to the inlet.

17. A machine as set forth in claim 15, wherein the means for converting pulls multiple sheets of stock material together as the stock material passes therethrough.

18. A machine as set forth in claim 15, wherein the guiding means provides a means for preventing one sheet from wrapping around another sheet in the converting means such that the strip of dunnage disposed from the conversion assembly can follow separate paths.

* * * * *